US011492794B1

(12) United States Patent
Jablonsky

(10) Patent No.: US 11,492,794 B1
(45) Date of Patent: Nov. 8, 2022

(54) FLANGE CONNECTOR FOR CONCRETE STRUCTURAL COMPONENT

(71) Applicant: ALP Supply, Inc., Fairless Hills, PA (US)

(72) Inventor: David S. Jablonsky, Washington Crossing, PA (US)

(73) Assignee: ALP Supply, Inc., Fairless Hills, PA (US)

( * ) Notice: Subject to any disclaimer, the term of this patent is extended or adjusted under 35 U.S.C. 154(b) by 0 days.

(21) Appl. No.: 16/883,021

(22) Filed: May 26, 2020

(51) Int. Cl.
*E04B 1/21* (2006.01)
*E04B 1/41* (2006.01)

(52) U.S. Cl.
CPC ..... *E04B 1/215* (2013.01); *E04B 1/41* (2013.01)

(58) Field of Classification Search
CPC ..... E04B 1/215; E04B 1/41
USPC ..... 52/699
See application file for complete search history.

(56) References Cited

U.S. PATENT DOCUMENTS 1,116,928 A * 11/1914 Sanderson ..... E04B 1/2608 16/217
1,199,077 A 9/1916 James
1,732,260 A 10/1929 Crawford
3,159,945 A 12/1964 Morte
3,645,056 A * 2/1972 Gerola ..... E04C 2/06 52/259
3,733,757 A * 5/1973 Scott ..... E04B 1/215 52/250
3,747,287 A * 7/1973 Finger ..... E04B 7/20 52/18

(Continued)

FOREIGN PATENT DOCUMENTS

GB 2033448 A * 5/1980 ..... E04B 1/4185
JP 11190194 7/1999

(Continued)

OTHER PUBLICATIONS

JVI, Inc., Vector Connector, Product Literature, Estimate 2016, p. 1-2.

(Continued)

*Primary Examiner* — Brian D Mattei
*Assistant Examiner* — Joseph J. Sadlon
(74) *Attorney, Agent, or Firm* — Timothy J. Monahan; Monahan & Company, LLC

(57) ABSTRACT

A flange connector is embedded in precast concrete structural member for use in joining adjacent concrete members together, wherein the flange connector is characterized by a center plate and legs extending back from each side of the center plate. Each of the legs is provided with projections extending from the top edge and bottom edge of the leg, in the same plane defined by the height and length of the leg. The projections extending from the top edge and the bottom edge of the leg may be mirror images of each other, so that the cross-sectional area of the leg is substantially the same over the portion of the leg with the projections. The legs of the flange connector may incorporate additional enhancements to increase the resistance to pull out, including a neck formed by notches in the top and bottom of each leg, adjacent the transition region extending from the center plate and one or more embossments creating a convex area on one side of each leg and a concave area on the opposite side of each leg.

16 Claims, 5 Drawing Sheets

(56) References Cited

U.S. PATENT DOCUMENTS 3,842,558 A 10/1974 Scholz et al.
3,958,954 A 5/1976 Ehlenbeck
4,231,198 A * 11/1980 Augier ..... E04B 1/21 403/174
4,404,781 A * 9/1983 Gilb ..... E04B 1/0007 52/295
4,422,279 A * 12/1983 Powell ..... E04B 1/0007 52/745.12
4,624,089 A * 11/1986 Dunker ..... E04C 2/288 52/712
4,724,649 A 2/1988 Lowndes, III
4,930,677 A 6/1990 Jolliffee
4,982,537 A * 1/1991 Matikainen ..... E04B 1/215 52/251
5,388,804 A * 2/1995 Cohen ..... E04B 1/4157 249/207
5,402,616 A 4/1995 Klein
5,595,031 A * 1/1997 Commins ..... E04B 1/0007 52/105
5,809,703 A 9/1998 Kelly
5,816,008 A * 10/1998 Hohmann ..... E04B 1/4178 52/565
6,176,059 B1 * 1/2001 Cantarano ..... E02D 29/0283 52/415
6,185,897 B1 2/2001 Johnson et al.
6,345,473 B1 * 2/2002 Fink ..... E04H 9/0235 52/258
6,532,714 B1 * 3/2003 Ferm ..... E04B 1/215 404/75
6,668,506 B2 12/2003 Snauwaert
6,854,232 B2 2/2005 Snauwaert
7,213,376 B2 * 5/2007 Pulkkanen ..... E04B 1/4121 52/707
7,461,492 B1 12/2008 Francies, III et al.
7,503,719 B1 * 3/2009 Ruel ..... E02D 29/0241 403/207
D619,883 S 7/2010 Hansort
D619,884 S 7/2010 Hansort
D619,885 S 7/2010 Hansort
7,866,116 B2 * 1/2011 Ollis ..... B21F 7/00 411/453
8,522,501 B2 9/2013 King
8,875,471 B2 * 11/2014 Siqueiros ..... E01C 23/04 52/745.2
9,359,757 B1 6/2016 King
10,132,077 B2 * 11/2018 Schillinger ..... E04F 13/0805
10,221,558 B1 * 3/2019 Silva ..... E04B 1/043
10,533,320 B2 * 1/2020 Ouellet ..... G01N 33/383
10,640,970 B2 * 5/2020 Sarda ..... E04B 1/215
11,408,167 B2 * 8/2022 Espinosa ..... E02D 35/00
2003/0101678 A1 * 6/2003 Snauwaert ..... E01C 5/08 52/712
2003/0140590 A1 7/2003 Lancelot, III et al.
2007/0056242 A1 3/2007 Sample
2009/0308005 A1 * 12/2009 Ireland ..... E04B 1/41 52/250
2013/0174499 A1 * 7/2013 Densmore ..... E04G 21/142 52/125.4

FOREIGN PATENT DOCUMENTS

WO WO-8808904 A1 * 7/2016 ..... E04C 3/26
WO WO-2016111513 A1 * 7/2016 ..... E04B 1/043

OTHER PUBLICATIONS

Wayback Machine Internet Archive, JVI-Inc.com, Screenshot taken Nov. 17, 2021 of archive date Jan. 14, 2019.
Ghorbanpoor, Al, P.E., Ph.D., Testing of the JVI Mid V in 4" Slabs, dated Jan. 2013; publication date unknown, p. 1-115.
ALP Supply, Inc., Precast Accessories Catalog, Alignment Connections—MC Series, 2018, pp. 98-99, ALP Supply, Inc., Fairless Hills, PA, US.

* cited by examiner

FLANGE CONNECTOR FOR CONCRETE STRUCTURAL COMPONENT

This invention is directed to a flange connector, which can be embedded in a concrete structural component. The flange connector has an exposed center plate, which can be welded to the center plate of another flange connector, which is embedded in an adjacent concrete structural component, to join the two structural components together.

BACKGROUND OF THE INVENTION

Precast structural components are used in the construction of ceilings, floors and walls in buildings and other structures, such as parking decks. Typically, multiple precast components are assembled on site, to create a unitary structure. Flange connectors, also referred to in the industry as weldments or weld plates, are embedded in the precast components and used to connect the multiple components together.

The flange connectors are characterized by a center plate, which is exposed in a side or face of the precast component, and legs, which extend backward from the center plate and are embedded in the precast component. During assembly, the center plate of the flange connector is aligned with the center plate of a flange connector in an adjacent structural component in the structure, and the center plates are welded together, for example, with an intermediate rod or slug. Welding the flange connectors together prevents relative movement between adjacent structural components.

The precast structural component may also include reinforcements, such as mesh, rods, rebar, and pre-stressed cable or strands. The reinforcements and the legs of the flange connector are both embedded in the precast component and their relative positions can affect the ease of manufacture, strength of the component, and the overall strength of the structure.

Ehlenbeck—U.S. Pat. No. 3,958,954 discloses a flange connector for precast concrete having legs that taper to a point from the center plate backwards.

Klein—U.S. Pat. No. 5,402,616 discloses a flange connector for precast concrete, wherein the center plate is perpendicular to the legs and the center plate extends upward relative to the legs.

Lancelot, III et al. —US Published Patent Application No. 2003/0140590 A1 disclose a flange connector having a C-shaped cross section. The legs taper from the center plate back. Slots are cut in the back of each leg, to allow the legs to receive and engage a reinforcing mesh in the concrete.

Johnson et al. —U.S. Pat. No. 6,185,897 disclose a flange connector having legs that are rotated 90° relative to the center plate. One leg may be positioned on top of a reinforcing mesh and the other leg may be positioned below the reinforcing mesh.

Snauwaert—U.S. Pat. Nos. 6,668,506 B2 and 6,854,232 disclose a flange connector having legs that rotate 90° as they extend backward. One leg may be positioned on top of a reinforcing mesh and the other leg may be positioned below the reinforcing mesh. Additionally, the legs may be provided with undulating sections to provide enhanced gripping and holding forces in the concrete.

Francies, III et al. —U.S. Pat. No. 7,461,492 B1 disclose a flange connector with legs, which are crimped along their length to create a wave-like structure, intended to enhance the pull out strength of the device in concrete. Two pairs of legs may extend back from the center plate. The legs are crimped perpendicular to the plane of the legs.

King—U.S. Pat. No. 8,522,501 B2 discloses a flange connector having legs extending perpendicularly back from the center plate. The flange connector may be oriented in the precast concrete slab with the legs at a downward tilt from front to back, which places the center face plate at an angle relative to vertical. The benefits are alleged to be greater shear force strength and it is easier to place reinforcements around the arms. The arms of the flange connector are provided with saw tooth edges, to increase the horizontal tensile capacity.

King—U.S. Pat. No. 9,359,757 B1 discloses a flange connector having a center plate, which is tilted at an angle of approximately 30° relative to the legs to facilitate field welding. The legs are rotated approximately 45° relative to the center face plate.

Hansort—U.S. Design Pat. No. D619,885 S discloses a connector having a face plate, with rebar legs attached to the face plate and extending outward at approximately 45°.

Sample—US Patent Application Publication 2007/0056242 A1 discloses a "U" shape flange connector, with the legs twisted 90° from the center.

Despite the prior art developments, there remains a need for a flange connector that is economical to manufacture, easy to position and stabilize during casting, provides a large welding area and is able to accommodate variations in slab alignment, is accessible for welding, resists pull out, and minimizes concrete cracking near the connector when movement occurs in a concrete structure incorporating the connector. The foregoing objectives are met by the present flange connector and its incorporation in a precast concrete structural component.

SUMMARY OF THE INVENTION

The flange connector of the present invention may be incorporated in the side of a precast, concrete member useful as a component in a structure, such as a building, parking deck, bridge overpass or the like. The concrete member may comprise a planar section or slab, such as the flange of a double tee. By way of example, the flange connector may be embedded in the side of the planar section, and the planar section may be positioned horizontally in the structure.

The flange connector has a center plate, a first and second transition region, one on each side of the center plate, and first and second legs, which extend backward from the transition regions. The flange connector is positioned in the concrete member, with the outer face of the center plate exposed and the legs embedded in the concrete member. Multiple flange connectors may be provided along the length of a side of the concrete member.

The center plate of the flange connector functions as a point of attachment for joining together adjacent concrete members in a structure. In particular, each of a first and second concrete members may be provided with a flange connector, whereby the flange connectors are positioned to align with each other, with their center plates facing, when the concrete members are incorporated in the structure. The center plates of the flange connectors can then be welded together, either directly or through an intermediary metal connector, such as a rod or slug. In one example, the precast concrete members may be double tees, and they may be joined along the flanges extending the length of each side of the double tees, to form the floor of a structure, such as a parking deck.

The flange connector is a unitary metal structure, that is, it is formed from a single piece of metal into the desired shape, such as by forging or stamping. The center plate of the flange connector has a front, back, top, bottom, first side and second side. Between the center plate and each of the legs is a transition region, wherein the flange connector transitions from a side of the center plate to the leg. The transition region may be relatively vertical, in an embodiment of the invention wherein the legs are aligned vertically. Or, the transition region may be provided with a % twist, in an embodiment of the invention wherein the legs are aligned horizontally.

The flange connector has a first leg and a second leg extending backward relative to the center plate. Each leg may be characterized by a proximal end, extending from the transition region, and a distal end, opposite the proximate end. The first leg and the second leg may be angled outward from each other, for example, at an angle of from 30° to 60°. In one embodiment of the invention, the transition region extends from the first side or the second side of the center plate to the proximate end of the corresponding leg, without deviation. In other words, there are no concave or convex sections in the transition regions that would allow movement of the center plate away from the legs, while the legs are embedded in a concrete structure.

The legs may have a substantially rectangular cross section, with a height that is greater than the width. Each of the first and second legs may be characterized by a plane, and references to the orientation of the plane are based upon a leg's height and length. The legs may be aligned vertically, horizontally, or at an angle between vertical and horizontal, when the flange connector is oriented in a concrete member, with the center plate exposed.

The center plate of the flange connector may be tilted backward from its bottom to its top at an angle of from 1 to 15°, in particular from 2 to 9°, relative to the position of the legs, which allows the legs of the connector to maintain a substantially horizontal position in a concrete structural component. Accordingly, when the flange connector is embedded in a concrete member, the front of the center plate will tilt backwards, thereby facilitating welding one flange connector to another flange connector.

Each of the legs has a top edge and a bottom edge, and a plurality of projections extending outward from the top edge and the bottom edge. The projections may extend substantially over the length of a leg. The projections may be sinusoidal relative to the edge of the leg, that is, the undulations are coplanar with the leg. Each of the first and second legs is also characterized by a spine, which is a central band of metal, which extends uninterrupted by the projections, between the proximate end and the distal end of the leg.

The projections on the top edge and bottom edge of each of the legs may be "in phase", wherein the apogee of a projection extending from one edge of the leg is opposite the nadir of projections on the opposite side. In other words, the projection on one edge of the leg corresponds to a depression on the opposite edge of the leg. For example, in the case of sinusoidal projections, the entire leg defines a sinusoidal wave. Accordingly, the cross-section of the leg, in particular, the height is approximately uniform over the length of the leg. This provides a number of advantages, including maintaining the tensile strength of the leg substantially constant over the length of the leg and avoiding weak sections, where portions of the height of the leg are removed to create projections, as in some prior art flange connectors.

The flange connector may be provided with one or more additional enhancements designed to increase the resistance to the flange connector being pulled from the concrete member selected from the following features. Each of the legs may be provided with a "neck" portion in proximity to or adjacent the corresponding transition region. The neck is characterized by a section of the first leg having a height $H_1$, which is less than the height of the leg $H_2$, wherein $H_2$ is measured at a location that is farther from the center plate than the neck. In other words, the height of the neck section of the leg is less than the height of the leg at a point beyond the neck, thereby creating a shoulder. Likewise, the second leg is characterized by a neck section having a height $H_3$, which is less than the height of the leg $H_4$, wherein $H_4$ is measured at a location that is farther from the center plate than the neck.

Another enhancement designed to increase the resistance to the flange connector being pulled from the concrete member is to provide an embossment, which creates a concave section on one side of each of the legs and a convex section on an opposite side of each of the legs, for example, by forging or stamping. A plurality of embossments may be provided along the length of each of the legs to increase the pull out strength of the flange connector, from the concrete member into which the legs are embedded. Additionally, embossments may be provided in the transition regions between the center plate and each of the legs.

The precast concrete member may also include reinforcing mesh positioned horizontally.

During the casting process, the legs of the flange connector may rest on the mesh, which conveniently aligns the flange connector in the concrete member. Alternatively, the flange connector may be positioned below a layer of mesh provided in the concrete. Additionally, the flange connector may be coupled to reinforcing rods, tensioning cables and the like, which are aligned in the concrete member, as is known in the art.

DETAILED DESCRIPTION OF THE INVENTION

Figure 1:
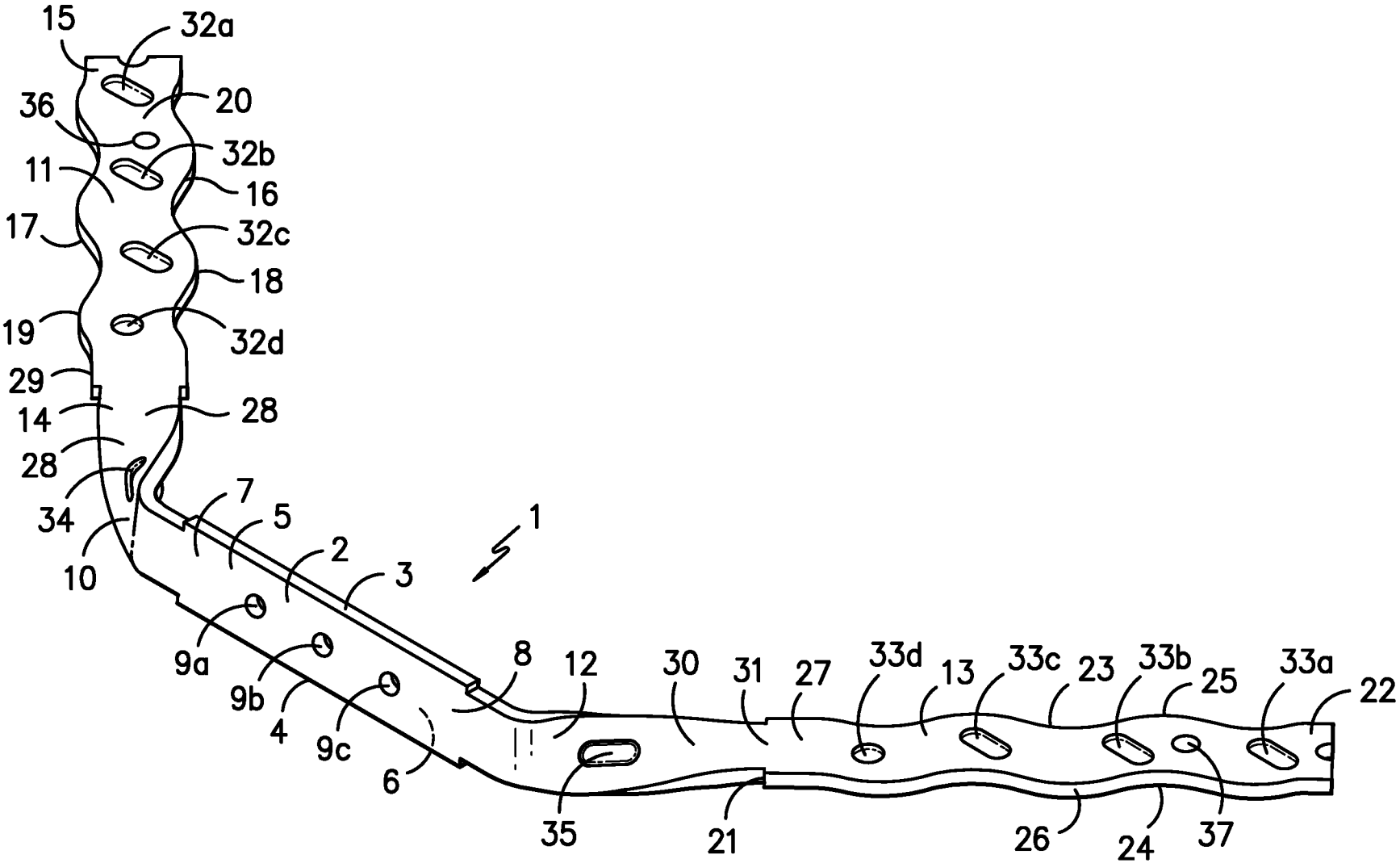
FIG. 1 is top perspective view of the flange connector, with a h twist transition to orient the legs horizontally.

Without intending to limit the scope of the invention, the preferred embodiments and features are hereinafter set forth. All of the United States patents and published applications cited in the specification are incorporated herein by reference.

Flange Connector

FIGS. 1-6 disclose a flange connector within the scope of the present invention. Flange connector 1 has center plate 2, with top 3 and bottom 4. Center plate 2 has front 5, back 6, first side 7 and second side 8. Holes 9*a*, 9*b* and 9*c* are placed in the center plate 2 to align a blockout, which is used to orient the flange connector in a precast form and protect front 5 from being coated with concrete, when the precast member is manufactured.

Figure 2:
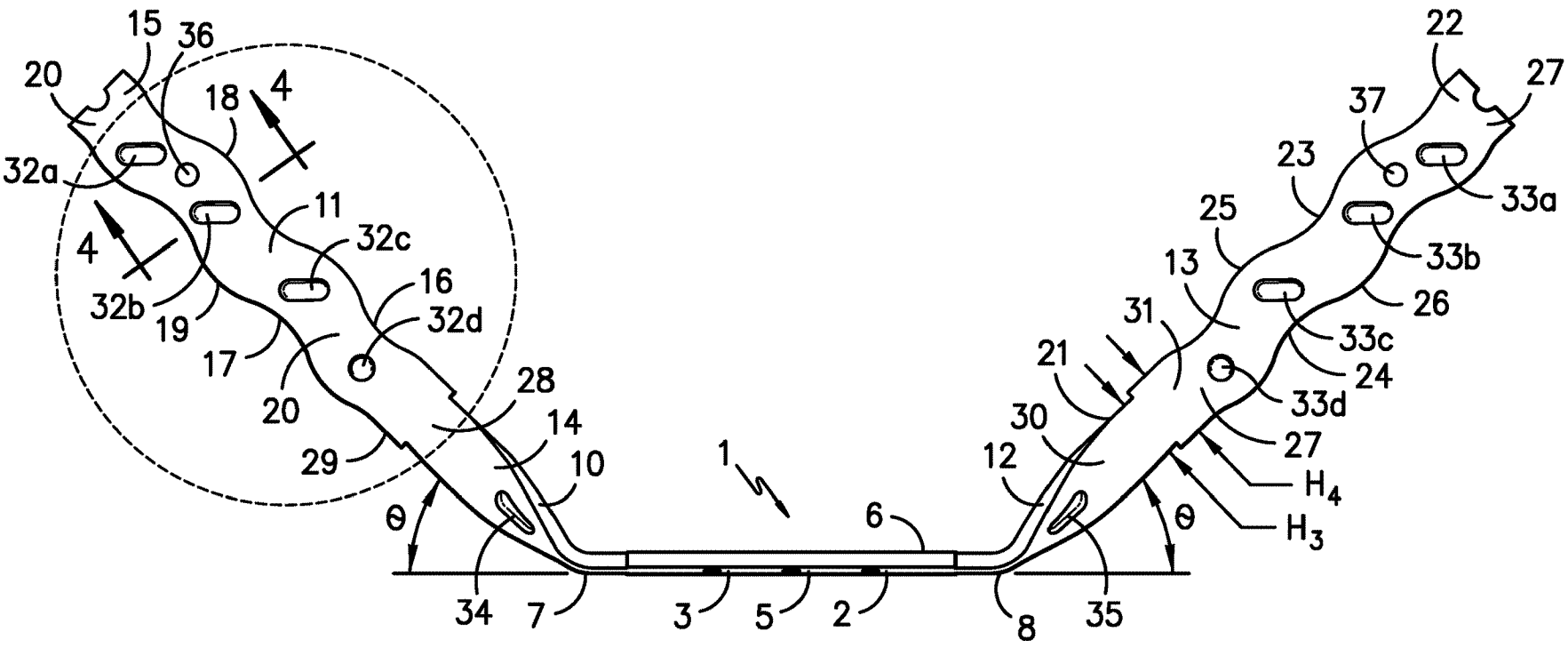
FIG. 2 is a top view of the flange connector of FIG. 1.
Figure 5:
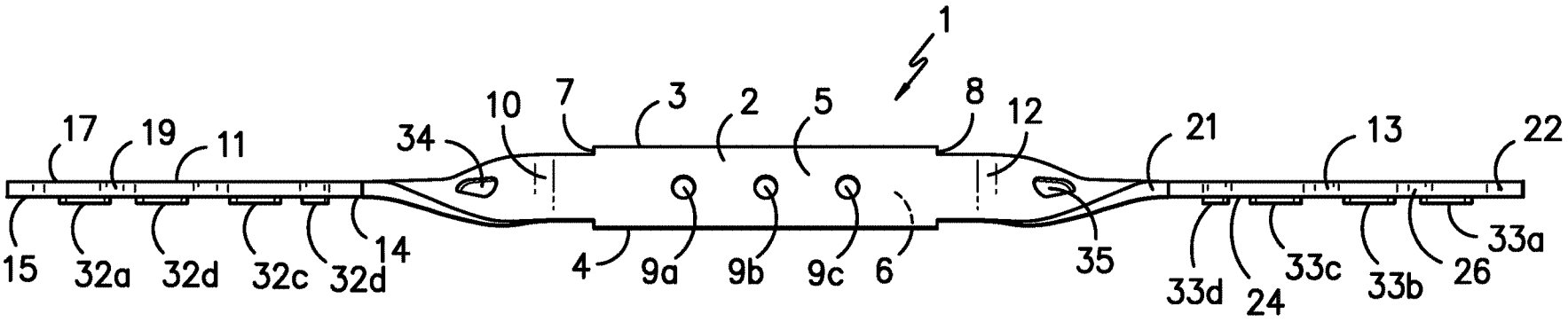
FIG. 5 is a front view of the flange connector of FIG. 1.
Figure 6:
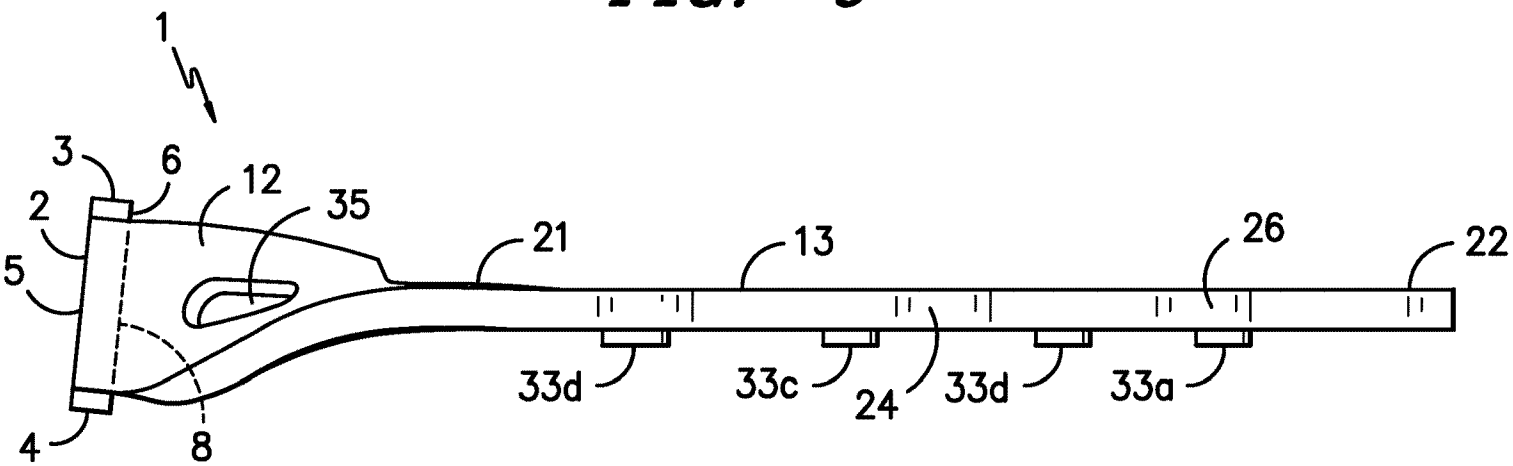
FIG. 6 is a side view of the flange connector of FIG. 1.

Transition region 10 extends from side 7, backward from front 5 of center plate 2, and is provided with a ½ twist to align leg 11 horizontally. Similarly, transition region 12 extends from side 8, backward from front 5 of center plate 2, and is provided with a ½ twist to align leg 13 horizontally. Referring to FIG. 2, legs 11 and 13 are shown extending backward relative to center plate 2 at an angle θ, which is approximately 45°. By way of example, angle θ may range from 30 to 60° relative to center plate 2. As illustrated in FIGS. 5 and 6, legs 11 and 13 may line in the same plane.

Also within the scope of the invention is the option of the transition regions on either side of the center plate to align the legs in a vertical plane or anywhere in between a vertical and horizontal plane. For example, the transition region may have no twist, in which case the plane of the legs is aligned vertically, or the transition region may have ¼ twist, in which case the plane of the legs is aligned at a 45° angle between vertical and horizontal.

Figure 3:
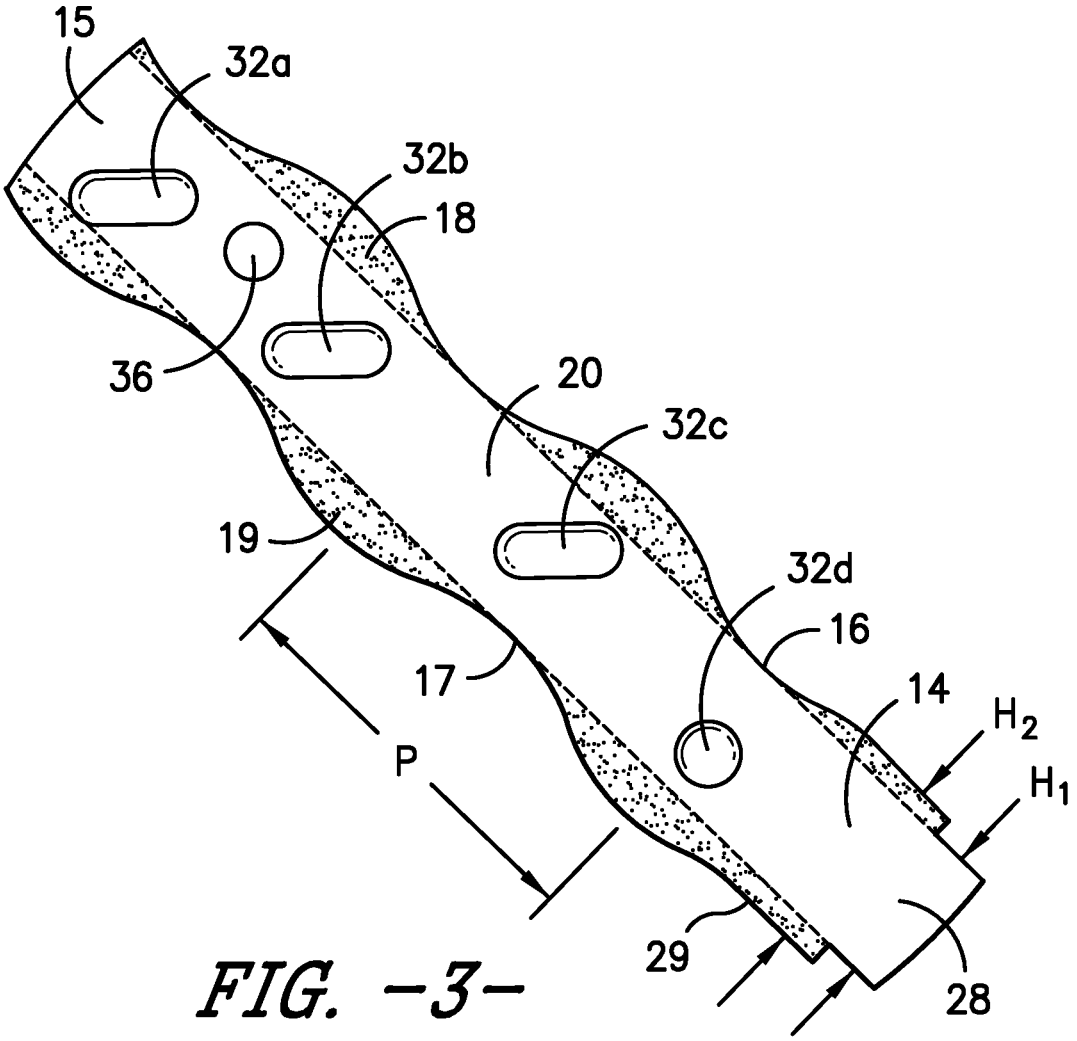
FIG. 3 is an enlarged view of one of the legs of the flange connector of FIG. 2.

Leg 11 has proximate end 14 extending from transition region 10 and distal end 15, opposite proximal end 14. Leg 11 has top edge 16 and bottom edge 17. Referring to FIGS. 2 and 3, leg 11 is provided with a series of projections 18, extending outward from top edge 16, and projections 19 extending outward from bottom edge 17. Projections 18 and 19 are in the same plane as leg 11. Top edge 16 and bottom edge 17 of leg 11 define a central band or spine 20, which extends from proximal end 14 to distal end 15.

In the embodiment of the flange connector disclosed in FIGS. 1-5, projections 18 and 19 are sinusoidal. Furthermore, projections 18 and 19 are "in phase", that is, when viewed perpendicular to the side of leg 11, projections 18 and 19 move together so that the cross-sectional height of leg 11 remains substantially constant, as shown by height "H" in FIG. 4. It can be understood that projections 18 and 19 of leg 11 may take other shapes than a sinusoidal wave. For example, the projections may be in the shape of a square wave or saw tooth.

Regardless of the exact shape of the projections, it is believed to be advantageous to provide sufficient spacing between the apogee and nadir of the projections, to increase pull out strength. The distance between the apogees of the projections is shown by pitch "P" in FIG. 4. By way of example the pitch may range from 1" to 3".

The features of leg 11 can be duplicated in leg 13 of flange connector 1. Accordingly, leg 13 is provided with proximal end 21 extending from transition region 12, and distal end 22, opposite proximal end 21. Leg 13 has top edge 23 and bottom edge 24. Projections 25 extend from top edge 23, and projections 26 extend from bottom edge 24. Top edge 23 and bottom edge 24 of leg 13 define a central band or spine 27, which extends from proximal end 21 to distal end 22. The orientation, alignment, spacing, height and pitch of the projections 25 and 26 of leg 13 may be substantially the same as disclosed herein with regard to projections 18 and 19 of leg 11.

Figure 4:
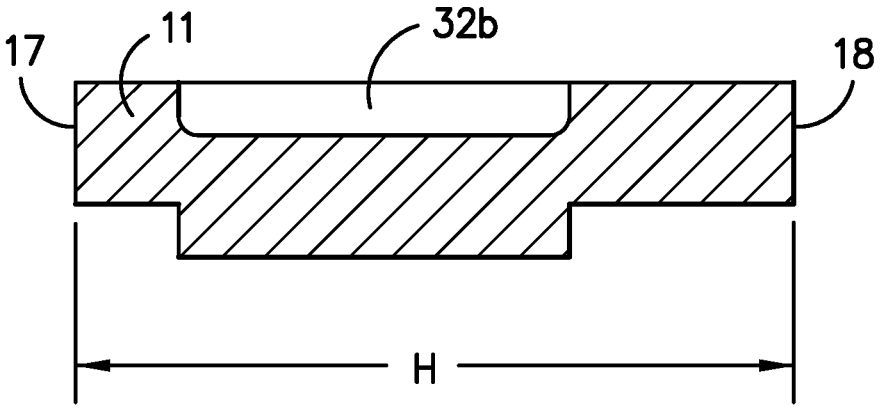
FIG. 4 is a cross-section view of one of the legs of the flange connector of FIG. 2.

Referring to FIG. 4, the spine of each of the legs, that is, spines 20 and 27, may represent from 50% to 95% of height H, more particularly from 70% to 90% of height "H", measured as the maximum distance from the edge of a leg to the projection directly on the opposite side, perpendicular to the longitudinal extent of the leg.

Legs 11 and 13 may be provided with one or more additional enhancements to increase the pull out resistance of flange connector 1, when it is embedded in a concrete member. In the embodiment of the invention shown in FIGS. 1-6, two different enhancements are employed. First, legs 11 and 13 are provided with a neck and shoulder arrangement. Referring to FIGS. 1-3, leg 11 has neck 28, positioned between the proximal end 14 and the distal end 15. Neck 28 has a height $H_1$. Leg 11 has shoulder 29 positioned between neck 28 and distal end 15, wherein the height of shoulder 29 is $H_2$, and wherein the height of $H_2$ is greater than the height $H_1$. In the embodiment of the invention illustrated, the difference in height between neck 28 and shoulder 29 creates a notch at both top edge 16 and bottom edge 17 of leg 11. By way of example, the height $H_1$ of neck 28 may be from 70% to 85% of the height $H_2$ of shoulder 29.

Leg 13 may be provided with a neck and shoulder feature, which is a mirror image of leg 11. Leg 13 has neck 30, positioned between the proximal end 21 and the distal end 22. Neck 30 has a height $H_3$. Leg 13 has shoulder 31 positioned between neck 30 and distal end 22, wherein the height of shoulder 31 is $H_4$, and wherein the height of $H_4$, is greater than the height $H_3$. The difference in height between neck 30 and shoulder 31 may be used to create notches at both top edge 23 and bottom edge 24 of leg 13.

While notches created at both the top edges and bottom edges of the legs are illustrated, it is believed that an increase in the pull out resistance of the flange connector can nevertheless be realized with a single notch, for example, when the relative height difference between the neck and shoulder creates a notch at either the top edge or bottom edge of each of the legs, and at the opposite edge the transition between neck and shoulder is smooth.

A second enhancement provided with flange connector 1 is one or more embossments incorporated in each leg, whereby the leg has been shaped to create a convex section on one side of the leg and a concave section on the opposite side of the leg. Leg 11 is provided with embossments 32*a*, 32*b*, 32*c*, and 32*d*, forming a raised, convex section on one side of leg 11 and a concave section on the opposite side of leg 11, for example by forging or stamping. Likewise, leg 13 is provided with embossment 33*a*, 33*b*, 33*c*, and 33*d*, forming a raised, convex section on one side of leg 13 and a concave section on the opposite side of leg 13. The embossments may also be provided in the transition regions. Transition region 10 has embossment 34, and transition region 12 has embossment 35. The concave and convex sections increase bond strength in concrete to improve resistance to shear and tensile loads. Additionally, the embossments in the transition region of the connector are believed to be particularly useful in increasing concrete capacity resistance to out-of-plane shear loadings.

By way of example, the embossments may extend from the surface of flange connector 1 a distance of from 1.5 to 3.5 mm, in particular from 2 to 3 mm. In the embodiment of the invention illustrated, the embossments are surrounded by a flat area, corresponding to the surface of the leg. Multiple embossments may be incorporated in each of the legs, spaced out along the length.

Legs 11 and 13 are provided with holes 36 and 37, respectively. The holes can be used to couple the flange connector to mesh, reinforcing rods, tensioning cables and the like, which are aligned in the concrete member, as is known in the art.

Structural Component Incorporating the Flange Connector

The flange connector is incorporated in a concrete member, when the concrete member is cast. Typically, the concrete member is "precast", that is the concrete is cast in a reusable mold or form, allowed to cure, and transported to the construction site, where it is incorporated into a structure. Examples of concrete structural components that may incorporate the flange connector include double tees, wall panels, and the like.

Figure 7:
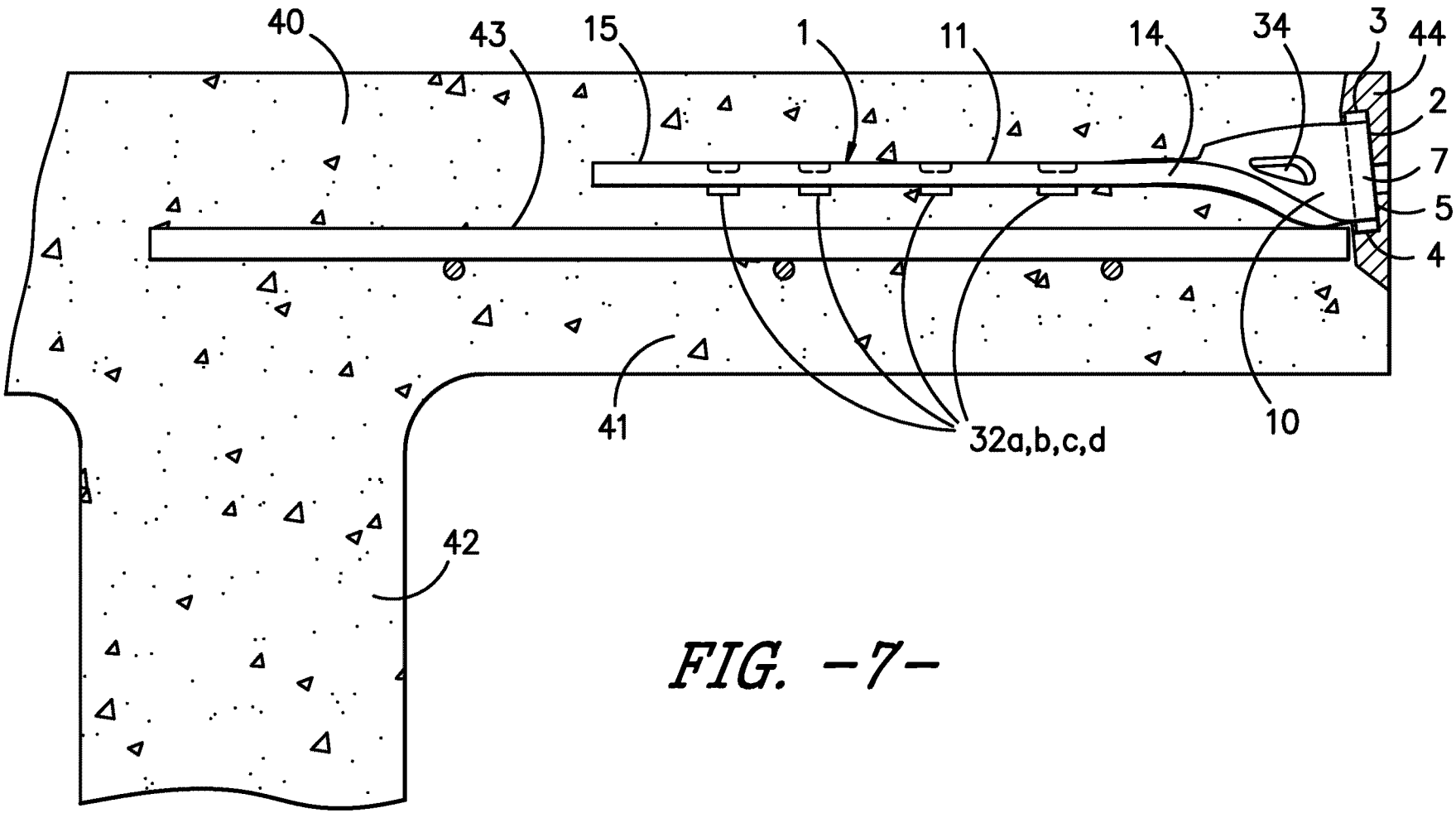
FIG. 7 is a sectional view of the connector of FIG. 1 is a concrete member, namely a precast double tee.

Referring to FIG. 7, flange connector 1 is shown embedded in concrete member 40. In the embodiment illustrated, concrete member 40 is a double T, having a planar flange 41 and stem 42 extending downward. Flange connector 1 is supported on metal mesh 43, which may be placed approximately in the middle of flange 41. Bottom 4 of center plate 2 extends down below mesh 43 and below the plane defined by the bottoms of legs 11 and 13. As shown in FIG. 7, blockout 44 is used to support flange connector 1 in the mold and to keep concrete from covering center plate 2. After concrete member 40 has cured, the mold (not shown) and blockout 44 are removed, thereby exposing center plate 2 for welding.

While flange connector 1 is illustrated in FIG. 7 as positioned above metal mesh 43, it is also within the scope of the invention to provide a precast concrete structure having the flange connector positioned below the metal mesh.

There are, of course, many alternatives and modifications of the invention, which are intended to be included in the following claims.

What I claim is:

1. A flange connector, comprising:

(a) a center plate having a front, back, top, bottom, first side and second side;

(b) a first transition region extending from the first side of the center plate and backward away from the front of the center plate, wherein the first transition region extends from the first side of the center plate to the proximal end of the first leg without deviation;

(c) a second transition region extending from the second side of the center plate and backward away from the front of the center plate, wherein the second transition region extends from the second side of the center plate to the proximal end of the second leg without deviation;

(d) a first leg having a top edge, a bottom edge, a proximal end extending from the first transition region, and a distal end opposite the proximal end, a spine extending a length of the first leg between the proximal end and the distal end, the first leg having a rectangular cross section characterized by a height, extending from the top edge to the bottom edge of the first leg, and a width, a plurality of projections extending from the top edge of the first leg, and a plurality of projections extending from the bottom edge of the first leg, wherein the first leg extends backward relative to the center plate at an angle of from 30° to 60°, and wherein the first leg further comprises a neck positioned between the proximal end and the distal end, and a shoulder positioned between the neck and the distal end, wherein the first leg has a height $H_1$ at the position of the neck and a height $H_2$ at the position of the shoulder, wherein $H_2$ is greater than $H_1$;

(e) a second leg having a top edge, a bottom edge, a proximal end extending from the second transition region, and a distal end opposite the proximal end, a spine extending a length of the second leg between the proximal end and the distal end, the second leg having a rectangular cross section characterized by a height, extending from the top edge to the bottom edge of the second leg, and a width, a plurality of projections extending from the top edge of the second leg, and a plurality of projections extending from the bottom edge of the second leg, wherein the second leg extends backward relative to the center plate at an angle of from 30° to 60°, and wherein the second leg further comprises a neck positioned between the proximal end and the distal end, and a shoulder positioned between the neck and the distal end, wherein the second leg has a height $H_3$ at the position of the neck and a height $H_4$, at the position of the shoulder, wherein $H_4$ is greater than $H_3$;

(f) wherein (i) the projections extending from the top edge of the first leg and the projections extending from the bottom edge of the first leg are in phase; and (ii) the projections extending from the top edge of the second leg and the projections extending from the bottom edge of the second leg are in phase; and (g) the flange connector is formed from a single piece of metal.

2. The flange connector of claim 1, wherein (i) the projections extending from the top edge and the bottom edge of the first leg are sinusoidal, and (ii) the projections extending from the top edge and the bottom edge of the second leg are sinusoidal.

3. The flange connector of claim 2, wherein (i) the spine of the first leg comprises between 70% and 90% of the height of the first leg, and (ii) the spine of the second leg comprises between 70% and 90% of the height of the second leg.

4. The flange connector of claim 2, wherein (i) the plurality of projections extending from the top edge of the first leg comprise a first projection, characterized by a first apogee, and a second projection, characterized by a second apogee, and wherein a distance between the first apogee and the second apogee of the first leg is from 1" to 3"; and (ii) the plurality of projections extending from the top edge of the second leg comprise a first projection, characterized by a first apogee, and a second projection, characterized by second apogee, and wherein a distance between the first apogee and the second apogee of the second leg is from 1" to 3".

5. The flange connector of claim 4, wherein (i) the spine of the first leg comprises between 50% and 95% of the height of the first leg, and (ii) the spine of the second leg comprises between 50% and 95% of the height of the second leg.

6. The flange connector of claim 2, wherein (i) the first leg is oriented in a horizontal plane, based on the height and the length of the first leg; (ii) the second leg is oriented in a horizontal plane, based on the height and the length of the second leg; and (iii) the center plate tilts backward from the bottom to the top, at an angle of from 1° to 15°, in relation to a vertical.

7. The flange connector of claim 6, wherein the first transition region is embossed to provide a concave section on one side of the first transition region and a convex section on an opposite side of the first transition region, and wherein the second transition region is embossed to provide a concave section on one side of the second transition region and a convex section on an opposite side of the second transition region.

8. The flange connector of claim 1, wherein (i) the plurality of projections extending from the top edge of the first leg comprise a first projection, characterized by a first apogee, and a second projection, characterized by a second apogee, and wherein a distance between the first apogee and the second apogee of the first leg is from 1" to 3"; and (ii) the plurality of projections extending from the top edge of the second leg comprise a first projection, characterized by a first apogee, and a second projection, characterized by second apogee, and wherein a distance between the first apogee and the second apogee of the second leg is from 1" to 3".

9. The flange connector of claim 8, wherein (i) the spine of the first leg comprises between 50% and 95% of the height of the first leg, and (ii) the spine of the second leg comprises between 50% and 95% of the height of the second leg.

10. An article comprising:

(a) a concrete structural component having an outer surface; and (b) a flange connector embedded in the concrete structural component, the flange connector, having (i) a center plate having a front, back, top, bottom, first side and second side, wherein the front of the center plate is exposed in the outer surface of the concrete structural component; (ii) a first transition region extending from the first side of the center plate and backward away from the front of the center plate, wherein the first transition region extends from the first side of the center plate to the proximal end of the first leg without deviation; (iii) a second transition region extending from the second side of the center plate and backward away from the front of the center plate, wherein the second transition region extends from the second side of the center plate to the proximal end of the second leg without deviation; (iv) a first leg having a top edge, a bottom edge, a proximal end extending from the first transition region, and a distal end opposite the proximal end, a spine extending a length of the first leg between the proximal end and the distal end, the first leg having a rectangular cross section characterized by a height, extending from the top edge to the bottom edge of the first leg, and a width, a plurality of projections extending from the top edge of the first leg, and a plurality of projections extending from the bottom edge of the first leg, wherein the first leg extends backward relative to the center plate at an angle of from 30° to 60°, and wherein the first leg further comprises a neck positioned between the proximal end and the distal end, and a shoulder positioned between the neck and the distal end, wherein the first leg has a height $H_1$ at the position of the neck and a height $H_2$ at the position of the shoulder, wherein $H_2$ is greater than $H_1$;

(v) a second leg having a top edge, a bottom edge, a proximal end extending from the second transition region, and a distal end opposite the proximal end, a spine extending a length of the second leg between the proximal end and the distal end, the second leg having a rectangular cross section characterized by a height, extending from the top edge to the bottom edge of the second leg, and a width, a plurality of projections extending from the top edge of the second leg, and a plurality of projections extending from the bottom edge of the second leg; wherein the projections extending from the top edge of the first leg and the projections extending from the bottom edge of the first leg are in phase; and the projections extending from the top edge of the second leg and the projections extending from the bottom edge of the second leg are in phase, wherein the second leg extends backward relative to the center plate at an angle of from 30° to 60°, and wherein the second leg further comprises a neck positioned between the proximal end and the distal end, and a shoulder positioned between the neck and the distal end, wherein the second leg has a height $H_3$ at the position of the neck and a height $H_4$, at the position of the shoulder, wherein $H_4$ is greater than $H_3$; and (vi) the flange connector is formed from a single piece of metal.

11. The article of claim 10, wherein (i) the projections extending from the top edge and the bottom edge of the first leg are sinusoidal, and (ii) the projections extending from the top edge and the bottom edge of the second leg are sinusoidal.

12. The article of claim 11, wherein the concrete structural component is a double tee having a stem and a horizontal flange, and wherein the flange connector is embedded in the flange.

13. The flange connector of claim 11, wherein (i) the plurality of projections extending from the top edge of the first leg comprise a first projection, characterized by a first apogee, and a second projection, characterized by a second apogee, and wherein a distance between the first apogee and the second apogee of the first leg is from 1" to 3"; and (ii) the plurality of projections extending from the top edge of the second leg comprise a first projection, characterized by a first apogee, and a second projection, characterized by second apogee, and wherein a distance between the first apogee and the second apogee of the second leg is from 1" to 3".

14. The flange connector of claim 13, wherein (i) the first leg is oriented in a horizontal plane, based on the height and the length of the first leg; (ii) the second leg is oriented in a horizontal plane, based on the height and the length of the second leg; and (iii) the center plate tilts backward from the bottom to the top, at an angle of from 1° to 15°, in relation to a vertical.

15. The article of claim 14, wherein the first transition region is embossed to provide a concave section on one side of the first transition region and a convex section on an opposite side of the first transition region, and wherein the second transition region is embossed to provide a concave section on one side of the second transition region and a convex section on an opposite side of the second transition region.

16. The article of claim 13, wherein (i) the spine of the first leg comprises between 50% and 95% of the height of the first leg, and (ii) the spine of the second leg comprises between 50% and 95% of the height of the second leg.

* * * * *